United States Patent [19]

Collot

[11] Patent Number: 4,510,987

[45] Date of Patent: Apr. 16, 1985

[54] METHOD AND APPARATUS FOR CASTING METAL ALLOYS IN THE THIXOTROPIC STATE

[75] Inventor: Jean Collot, Antibes, France

[73] Assignee: Association pour la Recherche et le Developpemente des Methods et Processus Industrieles (Armines), Paris, France

[21] Appl. No.: 464,403

[22] Filed: Feb. 7, 1983

[30] Foreign Application Priority Data

Feb. 12, 1982 [FR] France ..... 82 02344

[51] Int. Cl.[3] ..... B22D 27/08; B22D 13/00

[52] U.S. Cl. ..... 164/71.1; 164/114; 164/286; 164/900

[58] Field of Search ..... 164/71.1, 114, 286, 164/900

[56] References Cited

U.S. PATENT DOCUMENTS 3,902,544 9/1975 Flemings et al. ..... 164/71.1
3,948,650 4/1976 Flemings et al. ..... 420/590

FOREIGN PATENT DOCUMENTS 1330525 5/1963 France .
2222157 10/1974 France .

OTHER PUBLICATIONS

Flemings et al, "Rheocasting Processes", *AFS Intl. Cast Metals Journal,* Sep., 1976, pp. 11-22.
Abstract of New Technology from the Air Force Systems Command, PB81-970567, "Centrifugal Rheocasting".

*Primary Examiner*—Kuang Y. Lin
*Assistant Examiner*—Richard K. Seidel
*Attorney, Agent, or Firm*—Gerald J. Ferguson, Jr.; Joseph J. Baker

[57] ABSTRACT

Equipment (3) for centrifugal casting from a crucible (5) into a mold (8) is modified by the addition of agitation means (19) movable relative to the crucible (5) and a heating furnace (30) which is movable relative to the mold (8) in order to heat the latter, before casting, to a temperature close to that of the alloy in the thixotropic state.

13 Claims, 13 Drawing Figures

METHOD AND APPARATUS FOR CASTING METAL ALLOYS IN THE THIXOTROPIC STATE

BACKGROUND OF THE INVENTION

1. Field of the Invention

The invention relates to the casting of metal alloys which have been formed into a thixotropic suspension as part of their preparation.

2. Description of the Prior Art

A suspension of this kind is obtained by heating a metal alloy to a temperature significantly higher than the liquidus temperature so that it becomes totally liquefied and then agitating it while its temperature reduces to a value between the liquidus temperature and the solidus temperature. The dendrites which tend to form during such cooling are transformed by such agitation into approximately spherical globules.

The state of the art is indicated by U.S. Pat. Nos. 3,902,544 and 3,948,650.

In the first of these patents (U.S. Pat. No. 3,902,544), it is stated that the thixotropic metal alloy may be continuously cast in ingot form, or injection molded in a metal mold, pressurized by a piston driven by a ram, or shaped to the required final form by compression between the two parts of a diestamping die.

In the second of the aforementioned patents, the casting of the thixotropic alloy into ingot molds to obtain ingots is envisaged. Such ingots may then be re-heated to a temperature between the solidus and liquidus temperatures and then shaped to the required form by a process such as stamping or forging.

It is advantageous to shape metal alloys to their final form from a thixotropic suspension since the difference between the intermediate temperature at which they are formed and their final temperature in the solid state is reduced, so that the risk of shrinkage and cracking during cooling is considerably reduced.

The merit of the invention consists in the recognition that it is possible to cast an alloy in the thixotropic state directly into a mold under the effect of centrifugal force. This avoids the necessity for the intermediate stage of casting an ingot, which has the following disadvantages:

- the further energy consumed to re-heat the ingots,
- the slowness of the process, which is effected in two stages,
- the further and relatively high consumption of energy for final shaping.

Also avoided is the use of shaping methods necessitating bulky and expensive tooling, such as stamping and injection molding under pressure.

SUMMARY OF THE INVENTION

The invention consists in a method of casting a metal alloy in a thixotropic state wherein said alloy is rendered thixotropic in a crucible and then transferred from said crucible into a mold by virtue of centrifugal force produced by rotating said crucible and said mold.

The mold is preferably heated to the temperature of the alloy by means of a removable furnace which is removed prior to rotating the mold-crucible combination.

The present invention also consists in apparatus for implementing a method of casting a metal alloy in a thixotropic state wherein said alloy is rendered thixotropic in a crucible and then transferred from said crucible into a mold by virtue of centrifugal force producted by rotating said crucible and said mold, said apparatus comprising a centrifugal casting machine incorporating a crucible, a mold adapted to be coupled to said crucible during rotation in order to transfer said alloy, and means adapted to agitate the contents of said crucible when molten.

The agitation means preferably comprise at least one movable agitator member adapted for fast and simple engagement with and disengagement from the crucible.

The apparatus preferably further comprises a furnace adapted to receive and contain a substantial part of the mold, movable relative to the mold and having a defined rest position.

Other objects and advantages will appear from the following description of examples of the invention, when considered in connection with the accompanying drawings, and the novel features will be particularly pointed out in the appended claims.

DESCRIPTION OF THE PREFERRED EMBODIMENTS

Figures 1, 2, 3:
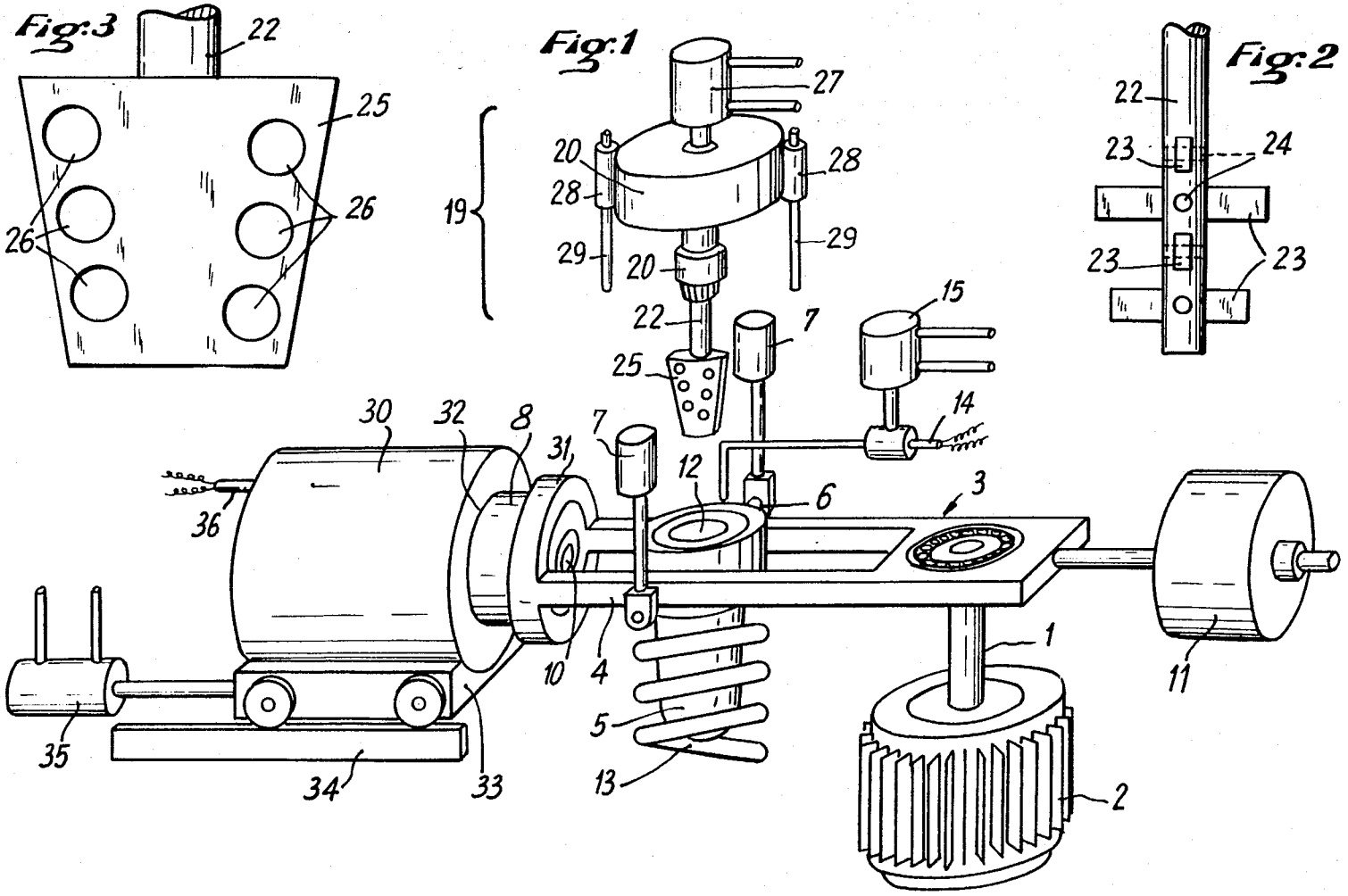
FIG. 1 is a general view of a preferred embodiment of an installation in accordance with the invention.
FIGS. 2 and 3 are detail views to a larger scale showing two embodiments of agitator members usable in the installation of FIG. 1.

Apparatus in accordance with the invention comprises a centrifugal casting machine which is known per se and will not therefore be described in detail. The machine comprises a vertical shaft 1 driven in rotation by an electric motor 2. Keyed to the upper end of shaft 1 to rotate with it, in a horizontal plane, is a rotating assembly 3 which comprises, on one side of shaft 1, a stirrup member 4 between the arms of which is a crucible 5 supported by a horizontal transverse shaft 6. Two counterweights 7 are disposed above shaft 6, opposite crucible 5. Between the ends of stirrup member 4 is mounted a mold 8 disposed horizontally with its opening 10 towards crucible 5. Opposite stirrup member 4, on the opposite side of shaft 1, rotating assembly 3 comprises a main counterweight 11. Crucible 5 and mold 8 are disposed so that, when assembly 3 is driven in rotation by motor 2, counterweights 7 incline outwardly so as to progressively tilt crucible 5 to a horizontal position with its opening 12, which was previously upwardly directed, directed towards mold 8 and in face to face relationship with opening 10 thereof. At this time, the contents of crucible 5 are transferred into mold 8. Associated with crucible 5, beneath rotating assembly 3, is an induction heating coil 13 which melts the contents of the crucible and which may be retracted downwardly in order to permit the rotation and centrifugal casting described hereinabove.

The temperature of the molten mass inside crucible 5 may be measured using an optical pyrometer or, as shown in FIG. 1, a thermocouple 14 which is retractable from crucible 5 by means of a pneumatic actuator 15.

The conventional machine which has just been described is routinely used for the centrifugal casting of dental prothesis parts, at a temperature above the liquidus temperature Tl. With a copper-tin test alloy containing 11% tin, the casting temperature is 1,200° C. for a liquidus temperature Tl of 985° C., in other words, 215° C. above temperature Tl. This alloy has a solidus temperature Ts of 780° C. This machine has been used to cast the same alloy at a temperature of 930° C., intermediate Tl and Ts. After melting the alloy at a temperature of 1,200° C., it was allowed to cool to 930° C. and then, while in a semi-solid/semi-liquid state, it was centrifugally cast by rotation.

The result is indicated in FIGS. *6a, 6b,* which show the opened mold 8. The cavity in the latter represents the impression of a dental prothesis. It can be seen that it has not been filled completely. A small quantity of metal 16 has filled the throat 17 of the cavity 18, but the greater part of the metal has remained in crucible 5.

In accordance with the invention, the machine described above is equipped with agitation means 19 comprising at least one agitator member adapted for fast and simple engagement with and disengagement from crucible 5. Agitation means 19 comprise a motor 20 with downwardly directed vertical shaft terminating in a chuck 21 in which is solidly fastened the upper end of a rod 22. This is fitted with a number of silicon nitride agitator members. Rod 22 may be fitted (see FIG. 2) with a number of diametral plates 23 which are staggered over a length substantially equal to the depth of crucible 5. These plates pass through rod 22 by means of holes provided for this purpose, and are immobilized by means of transverse pegs 24. The length of each plate 23 is determined according to the profile and transverse dimensions of crucible 5.

As an alternative (FIG. 3), rod 22 is cast from $Si_3N_4$ integrally with two oppositely disposed paddles 25 between which is contained the extreme bottom part of rod 22. Paddles 25 have a general profile which corresponds to the frustoconical internal profile of crucible 5. Beyond rod 22 they are pierced by several holes 26. For preference, holes 26 are in staggered arrangement between opposite sides of shaft 22. They are formed when the rod is cast.

Motor 20 of agitation means 19 is itself attached to the end of the piston rod of a top ram 27, and is provided laterally with spaced guides 28 which fit over slides 29. In this way, agitator members 23 or 25 may be lowered into crucible 5 and removed therefrom easily and quickly when crucible 5 is in a defined rest position.

In this example, agitation means 19 are disposed on supports (not shown) external to rotating assembly 3. Agitation means could be mounted on the latter, between shaft 1 and crucible 5, on the upper surface of stirrup member 4, for example. This would reduce the overall height of the machine, but the mass to be driven in rotation would be increased.

In both cases, which are equivalent from the point of view of the invention, rod 22 and agitator members 23, 25 must be adapted for rapid disengagement from crucible 5.

In accordance with the invention, it is extremely desirable, although not strictly necessary in all circumstances, to heat mold 8 to a temperature adjacent the intermediate temperature of the thixotropic state of the alloy to be cast, and preferably equal to this temperature. Rotating assembly 3 has a defined rest position in which a furnace 30 may be advanced in order to contain virtually all of mold 8. The latter is supported between the arms of stirrup member 4 and extends beyond their ends which are joined by a ring 31. Mold 8 is engaged in ring 31 and extends beyond the latter. Furnace 30 is hollow; it is disposed horizontally with its opening 32 directed towards mold 8. It is mounted on a carriage 33 which is itself movable along rails 34 by means of an actuator 35 to which it is coupled. Furnace 30 is preferably of the electrical resistance heater type and is equipped with a thermocouple 36 to monitor its internal temperature. In this manner, it is possible to advance furnace 30 so that it contains and heats mold 8 and to retract it to disengage the mold.

In this defined rest position, induction heating coil 13 surrounds crucible 5 to melt the alloy in it.

MODIFICATION

The centrifugal casting machine described hereinabove with crucible 5 tilting under the effect of centrifugal force may be modified in a manner known per se illustrated in FIGS. *5a* to *5c*. In this case, crucible 5 does not tilt; it remains vertical at all times, but has a lateral top opening 37 at that point on its outside wall which is furthest from shaft 1.

Mold 8 is linked to crucible 5 with its opening 10 mouth-to-mouth with opening 37. During rotation, the metal rises along the wall of crucible 5 opposite shaft 1 and passes into mold 8 through opening 37 and inlet 10.

This modification does not modify the apparatus in accordance with the invention in any other way, the apparatus still comprising the agitation means 19 suggested by rod 22 and paddles 25 in FIG. *5a* and the furnace 30 shown alone for reasons of simplification on FIG. *5a*.

OPERATION

The operation of the apparatus for implementing the method in accordance with the invention comprises the following successive stages:

(1) (FIGS. *4a* and *5a*)

(a) heating of mold 8 to an intermediate temperature Tm between the liquidus temperature Tl and the solidus temperature Ts of the metal alloy: $Ts<Tm<Tl$. Mold 8 may be pre-heated in a furnace external to the apparatus, prior to being maintained at temperature Tm by furnace 30;

(b) Melting of the metal alloy at a temperature Tc1 higher than the liquidus temperature: $Tc1>Tl$.

(2) (FIGS. *4b* and *5b*)

(a) The agitator is lowered and paddles 25 rotated to stir the metal at temperature Tc1;

(b) Crucible 5 is cooled to a temperature Tc2 intermediate Ts and Tl: $Ts<Tc2<Tl$.

(3) (FIGS. *4c* and *5c*)—The following operations are then begun simultaneously:

(a) the agitator is stopped, (b) paddles 25 are raised, (c) furnace 30 is retracted to release mold 8, (d) induction heating means 13 are retracted downwardly to release crucible 5, (e) thermocouple 14 is retracted upwardly.

As soon as operations a to e have been executed, motor 2 rotates shaft 1.

Figure 5A:
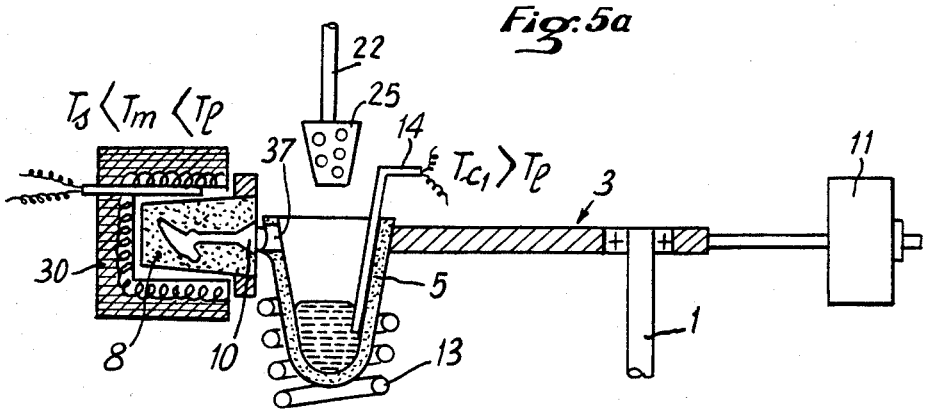
FIGS. 5*a*, 5*b*, 5*c* are views analogous to those of FIGS. 4*a*, 4*b*, 4*c* showing an alternative embodiment.
Figure 5B:
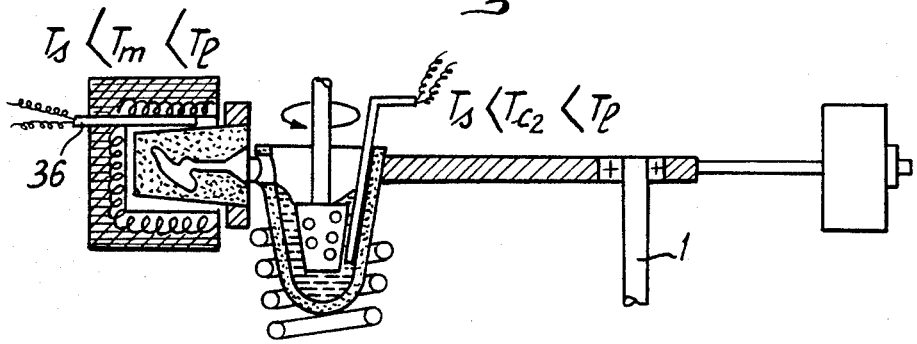
Figure 5C:
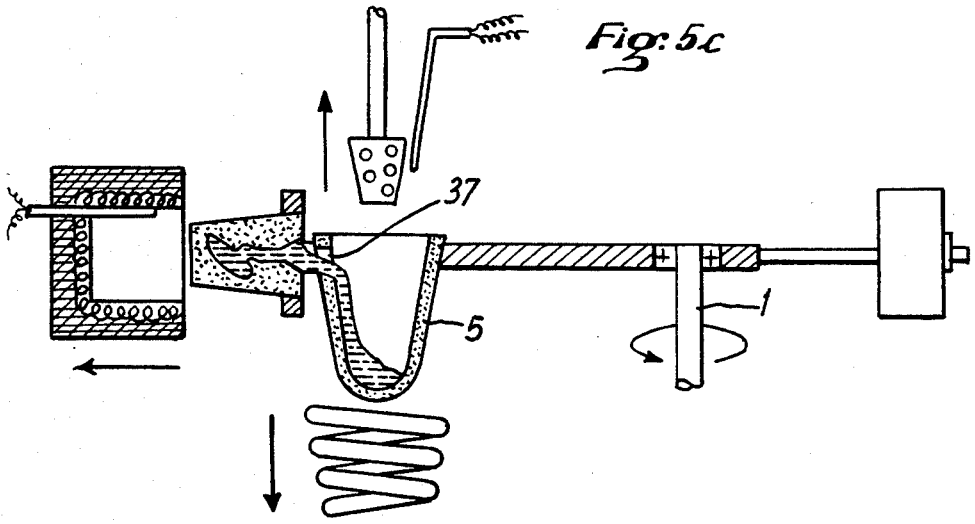

In the case of a non-tilting type crucible 5, the metal flows through orifice 37 (FIG. 5*c*).

Figure 4A:
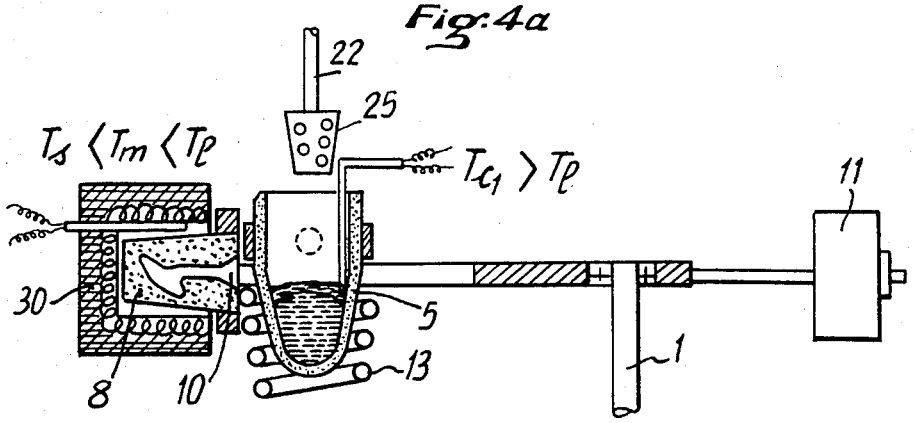
FIGS. 4*a*, 4*b*, 4*c* are detail views showing various positions of the principal component parts of the apparatus in accordance with the invention during their utilization.
Figure 4B:
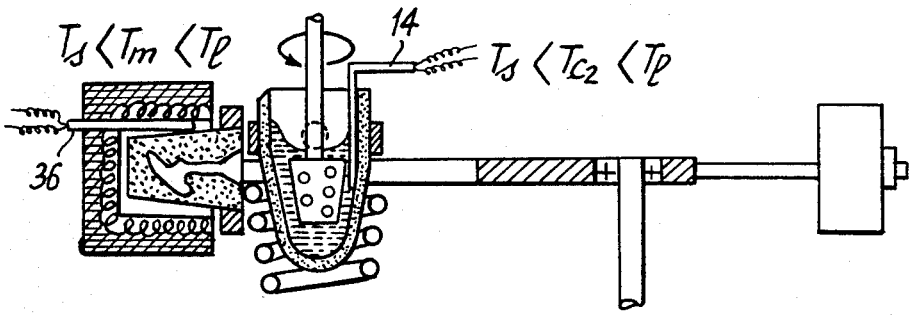
Figure 4C:
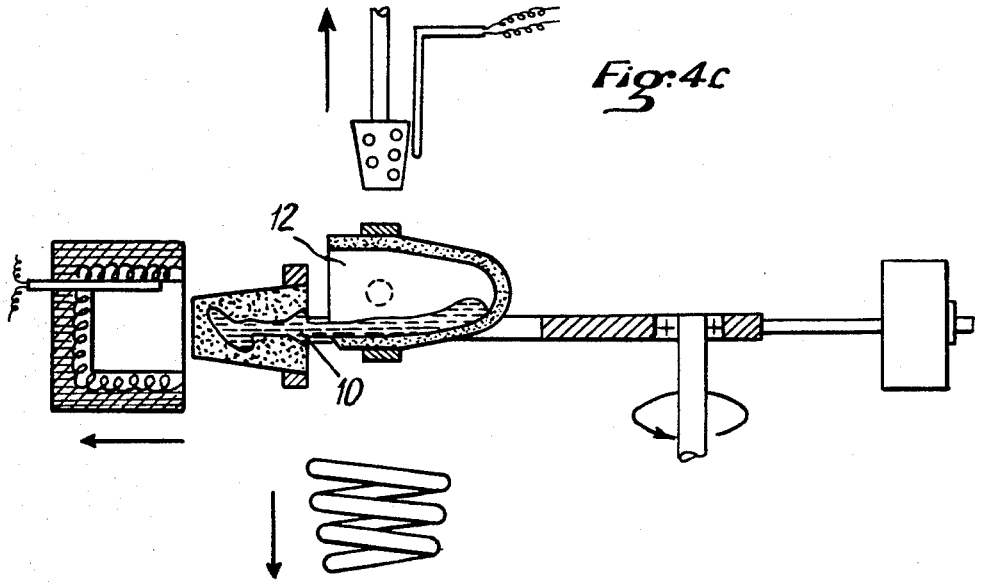

In the case of a tilting type crucible 5, counterweights 7 incline it horizontally by virtue of centrifugal force and the metal is projected directly from orifice 12 of crucible 5 through the inlet of mold 8 into throat 17 of its cavity (FIG. 4*c*).

Figure 6A:
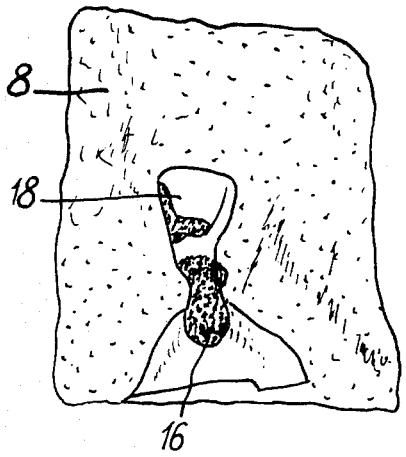
FIGS. 6*a*, 6*b* are views of the two halves of a mold, showing the result of a casting operation effected by a conventional centrifugal machine without application of the method in accordance with the invention.
Figure 6B:
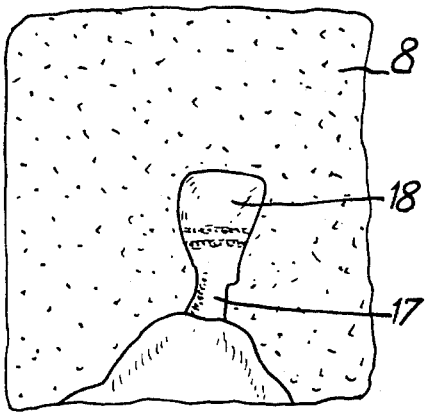

A test was carried out using the apparatus in accordance with the invention to cast the same copper-tin alloy containing 11% tin as mentioned hereinabove into a mold having the same impression 18, but using the method in accordance with the invention, for comparison with the conventional casting test described hereinabove with reference to FIGS. 6*a*, 6*b*.

For the second test, carried out in accordance with the invention, mold 8 was heated and maintained at temperature Tm=930° C. by furnace 30. The alloy was first melted at temperature Tf=1,200° C.

The paddles 25 of agitator 19 were lowered into crucible 5 and then caused to rotate. The temperature in crucible 5 was allowed to reduce to 930° C. with agitation maintained.

After stirring for a few minutes, furnace 30, agitator 19, thermocouple 14 and induction heating coil 13 were retracted and centrifugal casting effected immediately by rotating shaft 1 at 400 rpm.

Figure 7:
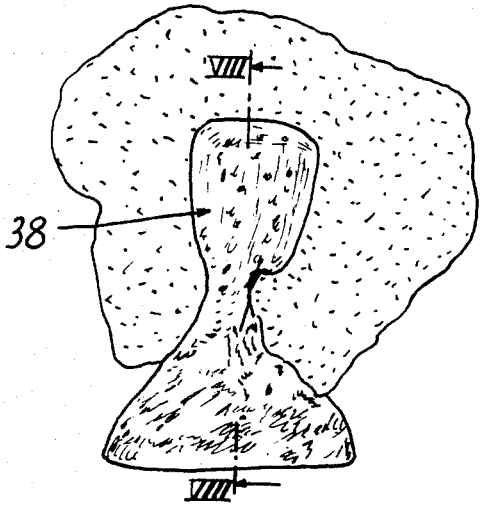
FIG. 7 is a view analogous to FIG. 6*a* of half of a mold showing the result of a casting operation effected using the centrifugal machine of FIG. 1 and the method in accordance with the invention.

Following removal of the mold, it was found that cavity 18 of mold 8 was completely filled, as shown in FIG. 7.

Figure 8:
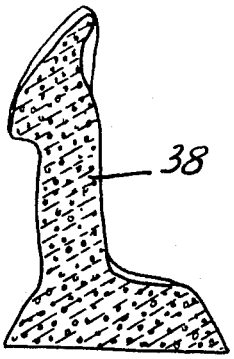
FIG. 8 is a cross-section through the casting removed from the mold shown in FIG. 7, on the line VIII—VIII.

Cavity 18 was the impression of a dental prothesis 38 shown in cross-section in FIG. 8. This shows that the part required was complete, totally sound and of a structure which was not dendritic but rather composed of numerous globules of approximately spherical shape.

Starting with a conventional centrifugal casting machine, the invention offers the improvement of rendering the machine suitable for manufacturing parts cast in the thixotropic state, with all the associated advantages. It should also be noted that the casting temperature during the second test, carried out in accordance with the invention, was 270° C. less than the temperature for the conventional casting.

The invention shows that, contrary to what has been generally believed so far, the forming of an alloy in the thixotropic state does not require considerable pressure or powerful machinery, as in injection molding in a closed mold or diestamping. Centrifugal force is sufficient to produce a sound part from a thixotropic alloy in an open mold, at rotation speeds which are normal for this type of molding operation.

In the example described hereinabove, the agitation means consists in a mechanical arrangement designed to be removed from the crucible. In its most general aspect, the invention provides the combination of a centrifugal casting machine with appropriate agitation means, not necessarily mechanical in nature. In certain circumstances, the heating of the alloy and the keeping of the alloy melted by means of induction heating coil 13 generate in the alloy sufficient agitation to keep it in the thixotropic state. Where necessary, an additional electromagnetic circuit may be added to induction heating coil 13 so as to stir the metal in the semi-liquid/semi-solid state in order to give rise to thixotropic conditions. The invention also covers such non-mechanical agitation means.

It will be understood that various changes in the details, materials and arrangements of parts, which have been herein described and illustrated in order to explain the nature of the invention, may be made by those skilled in the art within the principle and scope of the invention as expressed in the appended claims.

I claim:

1. A method of casting a metal alloy in a thixotropic state, said method comprising the steps of agitating said alloy in a crucible to render said alloy thixotropic, and then transferring said thixotropic alloy from said crucible directly into a mold by virtue of centrifugal force produced by rotating said crucible and said mold.

2. A method according to claim 1, further comprising heating said mold prior to casting to a temperature similar to that of said thixotropic alloy.

3. Apparatus for implementing a method of casting a metal alloy in a thixotropic state wherein said alloy is rendered thixotropic in a crucible and then transferred from said crucible into a mold by virtue of centrifugal force produced by rotating said crucible and said mold, said apparatus comprising a centrifugal casting machine incorporating a crucible, a crucible rotating means, a mold coupleable to said crucible during said rotation in order to transfer said alloy directly from said crucible into said mold, and means for agitating the contents of said crucible when molten.

4. Apparatus according to claim 3, wherein said agitation means comprise at least one movable agitator member adapted for fast and simple engagement with and disengagement from said crucible.

5. Apparatus according to claim 3, wherein said agitation means comprise an electromagnetic circuit associated with said crucible and adapted to stir said alloy when in a semi-liquid/semi-solid state.

6. Apparatus according to claim 4, wherein said agitator member comprises a rod and staggered diametral plates attached to said rod.

7. Apparatus according to claim 4, wherein said agitator member comprises a rod cast from $Si_3N_4$ integral with two oppositely disposed paddles formed with holes.

8. Apparatus according to claim 6, wherein said agitator member has a general profile which corresponds to the internal profile of said crucible.

9. Apparatus according to claim 5, wherein said agitator means are disposed so as to move vertically above said crucible and have a defined rest position.

10. Apparatus according to claim 5, wherein said agitation means comprise a motor, a vertical shaft depending from said motor, a chuck on said shaft, and a rod adapted to be held in said chuck and equipped with agitator members.

11. Apparatus according to claim 5, further comprising a furnace adapted to receive and contain a substantial part of said mold, movable relative to said mold and having a defined rest position.

12. A method of casting a metal alloy in a thixotropic state, said method comprising:

subjecting said alloy in a crucible to agitation to produce a thixotropic alloy;

ceasing said agitation; and rotating said crucible and a mold to transfer said thixotropic allow directly from said crucible into said mold by centrifugal force.

13. Apparatus for casting a metal alloy in a thixotropic state, said apparatus comprising a centrifugal casting machine including:

a crucible;

a crucible rotating means;

a mold coupleable to said crucible during rotation of said crucible and said mold to transfer said alloy directly from said crucible to said mold;

means for agitating the contents of said crucible when molten; and means for ceasing agitation of the contents of said crucible prior to transferring said alloy directly from said crucible to said mold.

* * * * *